US009436122B2

(12) United States Patent
Ignatchenko et al.

(10) Patent No.: US 9,436,122 B2
(45) Date of Patent: Sep. 6, 2016

(54) SYSTEMS, METHODS AND APPARATUSES FOR AUTHORIZED USE AND REFILL OF A PRINTER CARTRIDGE

(71) Applicant: OLogN Technologies AG, Triesen/FL (LI)

(72) Inventors: Sergey Ignatchenko, Innsbruck (AT); Dmytro Ivanchykhin, Kiev (UA)

(73) Assignee: OLogN Technologies AG, Triesen/FL (LI)

( * ) Notice: Subject to any disclaimer, the term of this patent is extended or adjusted under 35 U.S.C. 154(b) by 0 days.

(21) Appl. No.: 14/800,962

(22) Filed: Jul. 16, 2015

(65) Prior Publication Data

US 2015/0316873 A1 Nov. 5, 2015

Related U.S. Application Data

(63) Continuation of application No. 14/210,048, filed on Mar. 13, 2014, now Pat. No. 9,104,140, which is a continuation-in-part of application No. 14/209,765, filed on Mar. 13, 2014.

(60) Provisional application No. 61/794,413, filed on Mar. 15, 2013, provisional application No. 61/858,868, filed on Jul. 26, 2013.

(51) Int. Cl.
*G03G 15/00* (2006.01)
*G03G 15/08* (2006.01)

(52) U.S. Cl.
CPC ..... *G03G 15/0863* (2013.01); *G03G 15/0894* (2013.01); *G03G 15/556* (2013.01)

(58) Field of Classification Search
CPC ..... G03G 15/0894; G03G 15/0863; G03G 15/556
USPC ..... 399/12, 27, 109
See application file for complete search history.

(56) References Cited

U.S. PATENT DOCUMENTS

| | | | |
|---|---|---|---|
| 5,610,635 | A | 3/1997 | Murray et al. |
| 5,646,660 | A | 7/1997 | Murray |
| 6,000,773 | A | 12/1999 | Murray |
| 6,290,321 | B1 | 9/2001 | Murray et al. |

(Continued)

OTHER PUBLICATIONS

International Search Report issued in PCT/IP2014/0059743 on May 27, 2015.

*Primary Examiner* — David Bolduc
*Assistant Examiner* — Barnabas Fekete
(74) *Attorney, Agent, or Firm* — Arnold & Porter LLP

(57) ABSTRACT

The systems, methods and apparatuses described herein provide a chip for a cartridge with dispensable material may be provided. In one aspect, the chip may comprise a non-volatile memory for storing a number tracking amount of dispensable material in the cartridge, a circuit with permanently and irreversibly changeable state and circuit components configured to receive and process a first message, and receive a second message. The first message may comprise a first command and an operation input value for a print job at the cartridge, and to process the first message may comprise decreasing the amount of dispensable material. The second message may comprise a second command to increase the amount of dispensable material. The circuit components may be further configured to ignore the second command if the circuit has permanently and irreversibly changed its state to prevent responding to requests to increase the number tracking amount of dispensable material.

20 Claims, 9 Drawing Sheets

(56) References Cited

U.S. PATENT DOCUMENTS

| | | | |
|---|---|---|---|
| 8,494,379 | B2 | 7/2013 | Kim |
| 2004/0049468 | A1 | 3/2004 | Walmsley |
| 2006/0029400 | A1 | 2/2006 | Nasu |
| 2006/0268092 | A1 | 11/2006 | Mongeon |
| 2009/0319802 | A1 | 12/2009 | Walmsley |
| 2014/0282906 | A1 | 9/2014 | Ignatchenko |

Request for Refill 360

| | |
|---|---|
| Nonce | 362 |
| Toner Requested | 364 |
| Can Identifier | 366 |
| Refilling device identifier | 368 |
| Amount of Toner | 370 |

FIG. 3D

SYSTEMS, METHODS AND APPARATUSES FOR AUTHORIZED USE AND REFILL OF A PRINTER CARTRIDGE

RELATED APPLICATIONS

This application is a continuation application of U.S. application Ser. No. 14/210,048 filed Mar. 13, 2014, pending, which claims priority to U.S. Provisional Applications No. 61/794,413, filed Mar. 15, 2013, and No. 61/858,868, filed Jul. 26, 2013, and U.S. Non-provisional application Ser. No. 14/209,765, filed Mar. 13, 2014, all entitled "Systems, Methods and Apparatuses for Authorized Use and Refill of a Printer Cartridge," the contents of these applications are incorporated herein by reference in their entireties.

FIELD OF THE DISCLOSURE

The systems, methods and apparatuses described herein relate to prevention of unauthorized cartridges or unauthorized refill of authorized cartridges.

BACKGROUND

With computers becoming household items, printers and copy machines have also become prevalent among households. Printers and copy machines, however, use toner or ink very quickly. As a consequence, the cartridges typically need to be replaced or refilled very often. The manufacturers of printers and copy machines often rely on the sale of replacement cartridges to generate a healthy revenue. However, the strong demand for cartridges has created a big market for unauthorized cartridges and/or unauthorized refills. These unauthorized cartridges and unauthorized refills adversely financially impact the manufacturers of printers and copy machines.

Some manufacturers install a chip on their cartridges to record the amount of ink or toner in the cartridge. However, the chip can be reset by a refill kit sold by unauthorized dealers or in some situations, the chip can be replaced with another chip supplied in the refill kit. Either way, the existing technology has severe shortcomings in dealing with unauthorized cartridges and/or unauthorized refills. Therefore, there is a need in the art to provide systems, methods and apparatuses that prevent uses of unauthorized cartridges and/or unauthorized refills.

BRIEF DESCRIPTION OF THE DRAWINGS

FIG. 3D is a block diagram of an exemplary data structure for a refill request according to the present disclosure.

DETAILED DESCRIPTION

Figure 1:
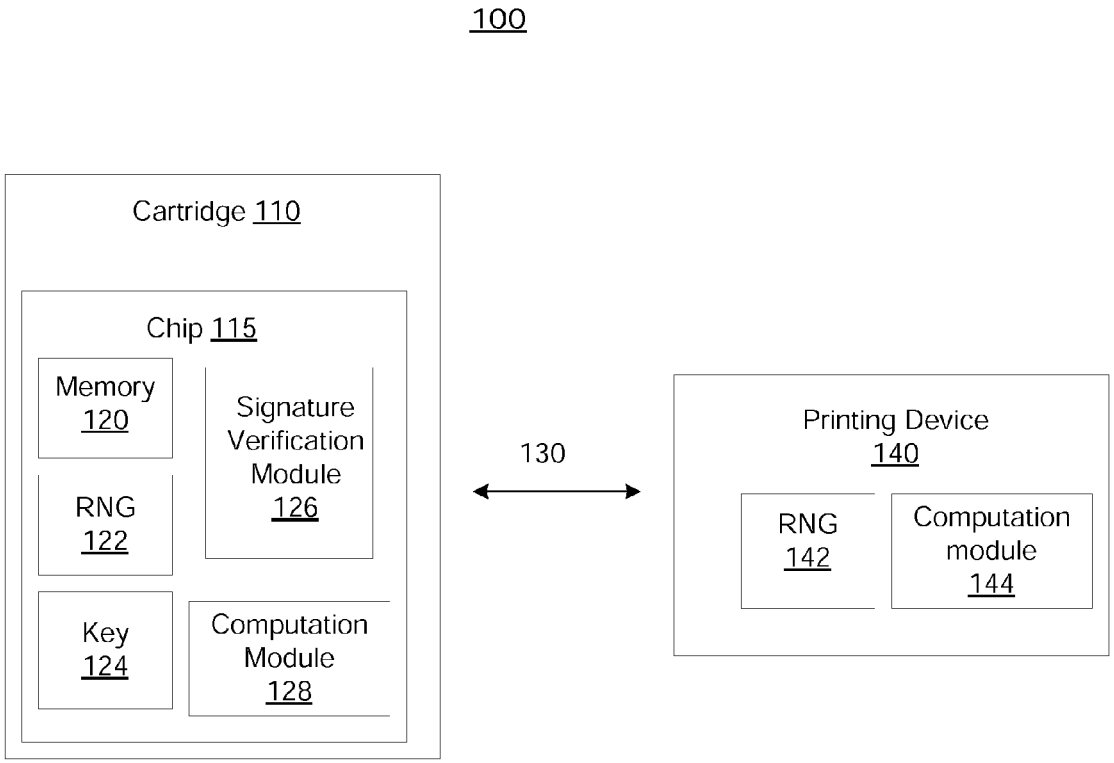
FIG. 1 is a block diagram of an exemplary system for using an exemplary cartridge according to the present disclosure.

Certain illustrative aspects of the systems, apparatuses, and methods according to the present invention are described herein in connection with the following description and the accompanying figures. These aspects are indicative, however, of but a few of the various ways in which the principles of the invention may be employed and the present invention is intended to include all such aspects and their equivalents. Other advantages and novel features of the invention may become apparent from the following detailed description when considered in conjunction with the figures.

In the following detailed description, numerous specific details are set forth in order to provide a thorough understanding of the invention. In other instances, well known structures, interfaces, and processes have not been shown in detail in order not to unnecessarily obscure the invention. However, it will be apparent to one of ordinary skill in the art that those specific details disclosed herein need not be used to practice the invention and do not represent a limitation on the scope of the invention, except as recited in the claims. It is intended that no part of this specification be construed to effect a disavowal of any part of the full scope of the invention. Although certain embodiments of the present disclosure are described, these embodiments likewise are not intended to limit the full scope of the invention.

The present disclosure comprises systems, methods and apparatuses for prevention of using unauthorized cartridges or unauthorized refill of authorized cartridges. While the present invention is described and explained in the context of refill of an ink or toner printer or copier cartridge, it is to be understood that it is not so limited and may be applicable to any systems, methods and apparatuses directed to preventing unauthorized use and/or refill on an apparatus. Moreover, while the specification generally refers to toner cartridges, it is to be understood that the concepts discussed herein apply to any apparatuses that dispense material (e.g., ink, toner) to print text and/or graphics on paper.

In one embodiment, a cartridge may be provided with a chip. The chip may comprise an encryption key and a computation engine. The encryption key may be a public key corresponding to a private key stored at a central server and may be used to verify a refill authorization signed by the central server during a refill operation. The computation engine may be configured for fast computation of a predefined calculation operation and may be used to prove to a printing device that the cartridge is an authorized cartridge.

In another embodiment, a method for authorizing a refill may be provided. The method may comprise receiving a request from a cartridge to refill the cartridge, generating a request for refill and sending the request for refill to a central server for authorization. The request for refill may include a nonce received from the cartridge, a container identifier uniquely identifying a toner container that may be used to dispense toner for the refill and a device identifier uniquely identifying the refill device. The method may further comprise receiving a reply from the central server, determining that the reply is an authorization, performing the refill and forwarding the reply to the cartridge. In some embodiments, the request for refill may further include information about the type of toner requested and amount of toner requested.

In yet another embodiment, a method for performing a print job using an authorized cartridge may be provided. The method may comprise generating an initial operation input value at a printing device, sending the initial operation input value to a cartridge, receiving a response from the cartridge, verifying the response containing a calculation result that matches an expected value (which also may be referred to as a verification value) and the response being received within a pre-defined time threshold, and performing the print job when the verification is successful. In some embodiments, the initial operation input value may be a nonce generated by the printing device. In some other embodiments, the initial operation input value may be a number derived from the nonce using a pre-defined computation function.

FIG. 1 shows a block diagram of an exemplary system 100 for using an exemplary cartridge 110 according to the present disclosure. The exemplary cartridge 110 may be used by an exemplary printing device 140 to print documents. The exemplary cartridge 110 may comprise a chip 115. The chip 115 may comprise a non-volatile memory 120, a random number generator (RNG) 122, a key 124, a signature verification module 126 and a computation module 128. In some embodiments, the cartridge 110 may also include a cartridge identifier, for example, a cartridge serial number, that can be used to uniquely identify the cartridge. In one non-limiting embodiment, the cartridge identifier may be stored in the non-volatile memory 120. In some embodiments, the chip 115 may be tamper-resistant so that the non-volatile memory 120 and other components of the chip 115 could not be easily modified.

Figure 2:
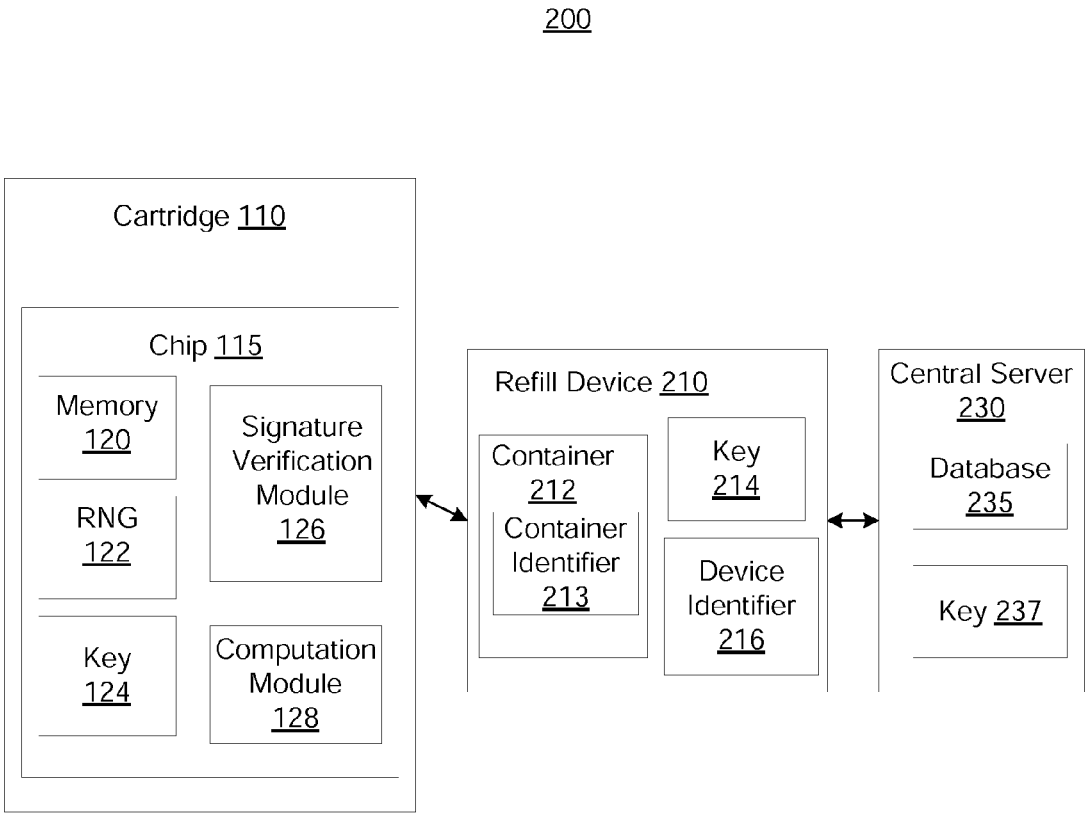
FIG. 2 is a block diagram of an exemplary system for refilling an exemplary cartridge according to the present disclosure.

The printing device 140 may comprise a RNG 142 and a computation module 144. Each of the RNGs 122 and 142 may be a hardware-based (such as, for example, a thermal-noise based, oscillator-jitter-based, or Zener noise-based generator), or software-based (such as, for example, linear congruential generator, Mersenne Twister generator, or cryptographic generator such as Blum-Blum-Shub, Yarrow or Fortuna) random number generator. The RNGs 122 and 142 may be used to generate nonces for secure communication with other devices (e.g., between the cartridge 110 and the printing device 140, between the cartridge 110 and a refill device as shown in FIG. 2, etc.). In embodiments in which the RNG 122 or 142 is software based, its initial state may be set to different values for different chips at the time of manufacture (or prior to first use). For example, in some embodiments it may be performed during standard chip testing procedures (such as IEEE 1149.1-based testing). Additionally, the chip 115 may collect and supply the RNG 122 or 142 with additional randomness obtained from various data, states and/or events. By way of example and not limitation, a subset of the bits constituting commands sent to the chip 115, the temperature of the chip 115 at a particular point in time, and/or the number of clock counts of a counter (not shown) between certain events may be obtained and supplied to the RNG as sources of randomness. In some embodiments, the chip 115 may process a command to add randomness. Such a command may have as a parameter, for example, comprising an externally generated random number. When such a command is received, the chip 115 may use the random number received to update the current state of the RNG.

The exemplary cartridge 110 and the printing device 140 may be coupled by an interface 130. The interface 130 may be a wired connection (such as serial, parallel, Ethernet, or USB), or a wireless connection (such as Bluetooth, near field communications, infrared, or various flavors of IEEE 802.11), and/or any suitable custom connection. In one embodiment, for example, the interface 130 may be a Serial Peripheral Interface (SPI) Bus.

The non-volatile memory 120 may store a number representing the amount of toner in the cartridge 110. In one non-limiting embodiment, the initial value of the number representing the amount of toner may be set at the time the toner cartridge 110 is filled for the first time. In another non-limiting embodiment, an initial value representing the amount of toner in the cartridge may be programmed into or stored in the memory 120 at the time that the chip 115 or cartridge 110 is manufactured. For example, in some embodiments it may be performed during standard chip testing procedures (such as IEEE 1149.1-based testing). In such an embodiment, the initial value need not be set at the same time the cartridge is filled for the first time but may be interpreted as corresponding to the amount of toner in a fully filled cartridge.

In some further embodiments, the cartridge 110 can only be filled once and cannot be refilled. In these embodiments, the chip 115 may have an on-chip fuse (or anti-fuse) which is permanently and irreversibly programmed after the initial value representing the amount of toner is written (and/or command(s) to add randomness is processed). When the fuse or anti-fuse is permanently and irreversibly programmed, the chip 115 may stop responding to requests to write the initial amount of toner and/or to commands to add randomness.

In yet another non-limiting embodiment, the initial state of the memory 120 after manufacture and prior to any initialization, wherein this state is the same for all the memories 120 incorporated into the chips 115, may be interpreted as corresponding to the amount of toner in a fully filled cartridge. By way of example, if an EEPROM or a flash memory is used to implement the non-volatile memory 120, as a result of the manufacturing process all of the bits of the EEPROM or flash memory may have the same value (for example, all the bits may be set to 1). In such an embodiment, the default state (e.g., when all the bits are set to 1) may be interpreted as corresponding to the amount of toner in a fully filled cartridge.

The key 124 may be a public encryption key of a public/private key pair. For example, the key 124 may be an Elliptic Curve Cryptography (ECC) public key (e.g., ECC-224), or an RSA public key. The signature verification module 126 may implement a signature verification algorithm based on the public key 124. For example, the signature verification module 126 may implement a secure hash algorithm (e.g., SHA-0, SHA-1, or SHA-2) and/or ECC verification.

The computation module 128 may be a dedicated computation module that is configured to perform one or more pre-defined calculation operations and to be able to perform the pre-defined operations very quickly. For example, the computation engine 128 may be implemented in an Application-Specific Integrated Circuit (ASIC) favoring speed of processing and may be much faster than a corresponding field programmable gate arrays (FPGAs) implementation. The ASIC implementation may also be much faster than software emulation using the combination of general purpose CPUs and/or graphical processing units (GPUs). In one non-limiting embodiment, the computation module 128 may be configured for computing recursively a hash value from an initial input value received by the computation module 128. For example, using an initial value $V_0$ as an input parameter, a hash function H may be computed to obtain value $V_1$ (e.g., $V_1=H(V_0)$). The hash function may be any hash function such as, for example, SHA-1, or SHA-256. Then the hash function H may be applied to the value $V_1$ to obtain $V_2$ (e.g., $V_2=H(V_1)$). Such a process may be repeated N times (wherein N may be any integer greater than one) to obtain a resulting value $V_N$, wherein $V_N=H(V_{N-1})$. In one embodiment the hash function H may be pre-defined (e.g., by chip manufacturers or cartridge manufacturers), while the number N and initial value $V_0$ may be provided at runtime (e.g., during refill or print operations).

The computation module 144 may be configured to perform the same calculation operations as the computation engine 128 and may be used by the printing device 140 to verify a calculation result returned by the cartridge 110 during an operation. The computation speed of the computation module 144, however, does not need to be as fast as the computation module 128. In one or more embodiments, the computation module 144 may be implemented in hardware (e.g., ASIC or FPGA) or software (e.g., software emulator running on a general purpose CPU and/or GPU).

In one or more embodiments, identical chips 115 may be used in a plurality of cartridges (e.g., in a set of cartridges manufactured in a batch) to reduce manufacturing cost. In some other embodiments, the chips 115 may be changed often to ensure better security. In yet some other embodiments, only the public keys 124 may be changed periodically but other components of the chips 115 may be identical between different batches. With respect to any of the embodiments, it may be advantageous to mix chips from different batches before distribution so that cartridges sold in the same geographic area come from different batches.

FIG. 2 is a block diagram of an exemplary system 200 for refilling the exemplary cartridge 110 according to the present disclosure. The refilling system 200 may comprise a refill device 210 and a central server 230 in addition to the exemplary cartridge 110 (which is the same as that of the system 100). The refill device 210 may comprise a container 212 of toner for cartridge refill. The container 212 may have a container identifier 213 (e.g., a serial number) that can uniquely identify the container 212. The refill device 210 may also comprise a key 214 and a device identifier 216. The key 214 may be a private key of a public/private key pair. The private key may be, for example, an RSA or ECC private key, which may be used for signing data sent from the refill device 210. The device identifier 216 may be a unique identifier for the refill device 210 (e.g., a device serial number) to uniquely identify the refill device 210. In addition, in some embodiments, the refill device 210 may also store a copy of the public keys 124 of the cartridge 110.

The central server 230 may have a database 235 and a key 237. The database 235 may store information about authorized refill devices. The stored information may include, for example, the device identifiers (e.g., the device identifier 216), public keys that correspond to the private key of the refill devices (e.g., the public key corresponding to the private key 214), information about current operators and/or owners of the refill devices, container identifiers (e.g., the container identifier 213) of each container acquired for each refill device, and the amount of toner remaining in each container. In a non-limiting embodiment, the public keys 214 may serve as unique identifiers for respective refill devices 210. The key 237 may be the private key that corresponds to the public key 124 stored at the cartridge 110 (and at the refill device 210 in some embodiments). In some embodiments, the key 237 may be stored in a database (e.g., the database 235 or another database accessible by the central server 230).

As shown in FIG. 2, the cartridge 110 may communicate with the refill device 210 for refill operations and the refill devices 210 may communicate with the central server 230. The communication connection between the refill device 210 and cartridge 110 may be a wired connection (such as serial, parallel, Ethernet, and USB), or a wireless connection (such as Bluetooth, near field communications, infrared, various flavors of IEEE 802.11), and/or any suitable custom connection. The communication connection between the refill device 210 and the central server 230 may include any suitable connections, for example, wired and/or wireless connections, and may include the Internet.

Figure 3A:
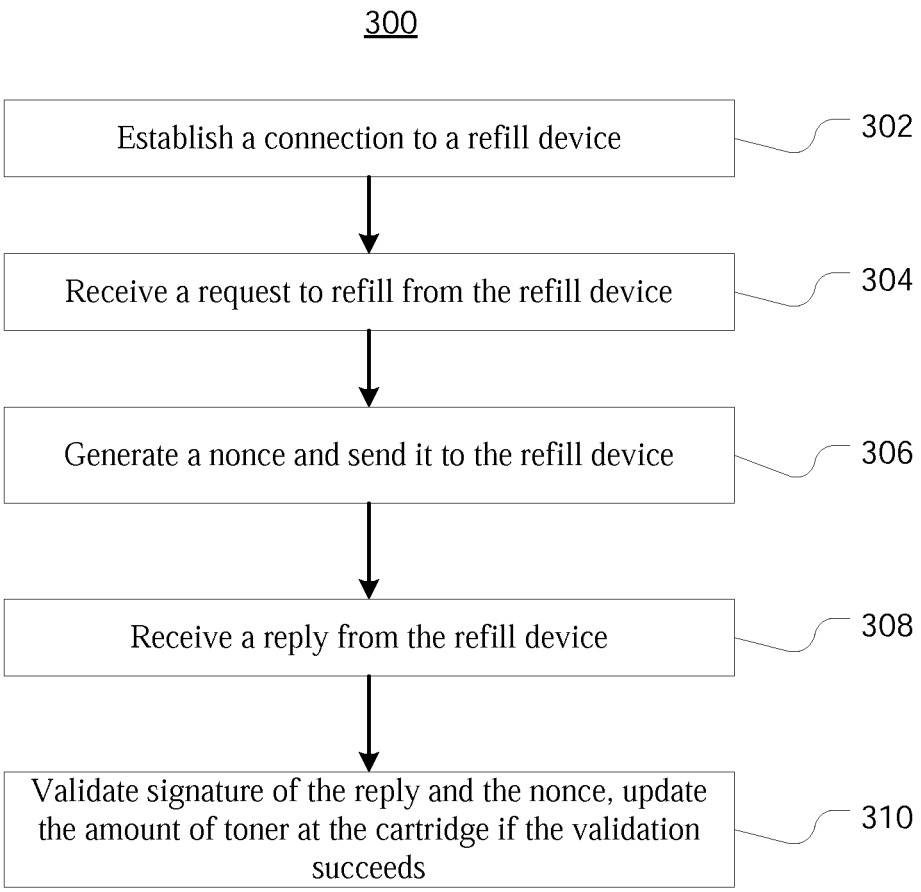
FIG. 3A is a flow diagram of an exemplary process for refilling an exemplary cartridge according to the present disclosure.

FIG. 3A is a flow diagram of an exemplary process 300 for refilling an exemplary cartridge according to the present disclosure. At block 302, the cartridge 110 may establish a communication/data connection to the refill device 210. At block 304, the cartridge chip 115 may receive a request from the refill device 210 to refill the cartridge 110. In an alternative embodiment, the cartridge chip 115 may generate a request to the refill device 210 to refill the cartridge 110. The request whether sent or received may, for example, initiate setting an amount of toner to the cartridge chip 115. At block 306, the cartridge chip 115 may generate a nonce using the RNG 122, and send the generated nonce to the refill device 210. The nonce may be of any length and in one embodiment may be 128 bits. In one embodiment, if the cartridge 110 stores its cartridge identifier, the cartridge identifier may also be sent along with the nonce to the refill device 210.

At block 308, the cartridge chip 115 may receive a reply from the refill device 210. As will be described below, the reply may be generated by a central server such as the central server 230 and forwarded to the cartridge 110 by the refill device 210. At block 310, the cartridge chip 115 may validate the signature of the reply using the key 124 (e.g., by using the signature validation module 126) and validate that the received nonce (in the reply) is the same as the nonce generated at block 306. In one embodiment, the cartridge chip 115 may also ensure that the time period from sending the nonce until receiving the reply may be within a pre-defined threshold. The pre-defined threshold may be any amount of time and in one embodiment may be 15 seconds. If all validations are successful, the chip 115 may write the amount of toner (e.g., the amount of toner requested in a request for refill sent by the refill device to the central server) into the non-volatile memory 120.

Figure 3B:
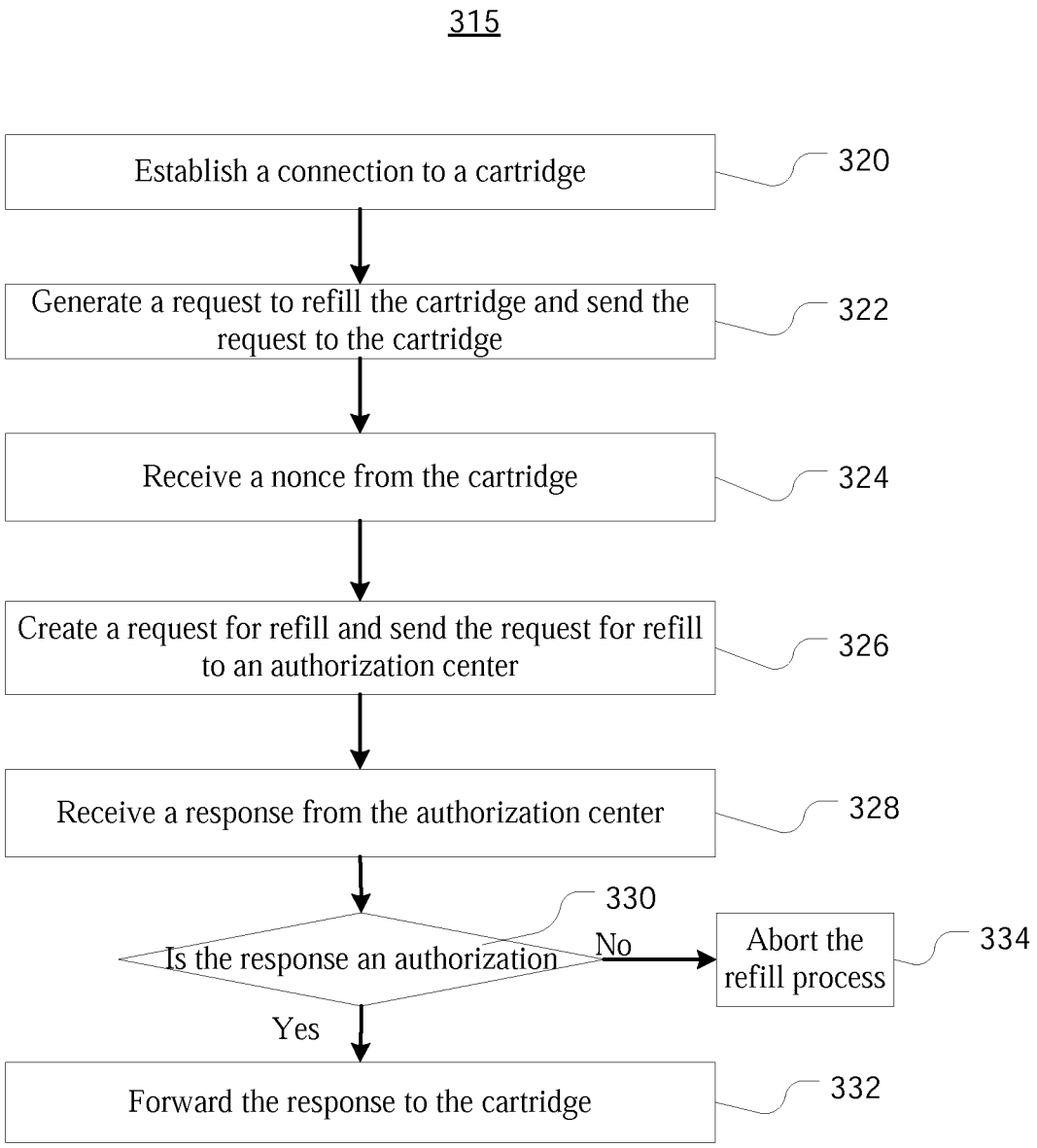
FIG. 3B is a flow diagram of an exemplary process for an exemplary refill device to refill an exemplary cartridge according to the present disclosure.

FIG. 3B is a flow diagram of an exemplary process 315 for an exemplary refill device to refill an exemplary cartridge according to the present disclosure. At block 320, the refill device 210 may establish a communication/data connection to a cartridge such as the cartridge 110. At block 322, the refill device 210 may generate a request to refill the cartridge and send the request to the cartridge. In an alternative embodiment, the refill device may receive from the cartridge a request to refill the cartridge. The request whether sent or received may, for example, initiate setting an amount of toner to the cartridge chip 115. At block 324, the refill device 210 may receive a nonce from the cartridge 110. In one non-limiting embodiment, the refill device 210 may also receive the cartridge identifier if the cartridge sends its cartridge identifier.

At block 326, the refill device 210 may generate a request for refill and send it to an authorization server (e.g., the central server 230). FIG. 3D shows an exemplary data structure for a request for refill 360 according to the present disclosure. As shown in FIG. 3D, the request for refill 360 may include a nonce 362, toner requested 364, a container identifier 366, a refill device identifier 368, and an amount of toner requested 370. The nonce 362 may be the nonce received from the cartridge 110 (e.g., the nonce generated at block 315 at the chip 115). The toner requested 364 may include information about the particular type of toner requested, for example, "blue toner type BT-198." The container identifier 366 may be the identifier of the container that the refill device may use to dispense the toner from (e.g., the container identifier 213 of the container 212). The refill device identifier 368 may be the device identifier of the refill device submitting the request for refill (e.g., the device identifier 216). The amount of toner 370 may be a number representing the amount of toner that needs to be dispensed into the cartridge to be refilled. In one embodiment, the request for refill 360 may be signed by the refill device 210 using the refill device's private key (e.g., the key 214). The signature may be sent along with the request for refill to the central server 230. In some embodiments, the cartridge identifier received from the cartridge may also be included in the request for refill 360.

At block 328, the refill device 210 may receive a reply from the authorization server (e.g., the central server 230) and determine whether the reply is an authorization or denial of authorization. If the reply is a denial of authorization, the process 315 may be aborted at block 334. For example, the refill device 210 may report an error message to an operator of the device and end the refill process 315. If the reply is an authorization, the process 315 may proceed to block 332, at which the refill device 210 may forward the reply to the cartridge 110 and also perform the physical act of refilling the cartridge. In some embodiments, the reply may be encrypted by the authorization server, for example, using the authorization server's private key. The refill device 210 may use one or more of the following ways to determine whether the reply is an authorization. For example, the refill device 210 may have a copy of the public key 124 that corresponds to the authorization server's private key and may use its copy of the public key 124 to decrypt the reply. Alternatively, the authorization server may send an additional message with the reply that indicates that the request has been granted. In one embodiment, the additional message may be signed by the refill device 210's public key (taken from the database 235). In another example, the reply to be forwarded to the cartridge 110 may be a part of a larger message sent to the refill device 210. The larger message may be signed by a public key of the refill device 210. In yet another example, the refill device 210 may receive all data over a secure connection (e.g., SSL), and the received data may contain both a message for the cartridge 110 and the permission for refill.

Figure 3C:
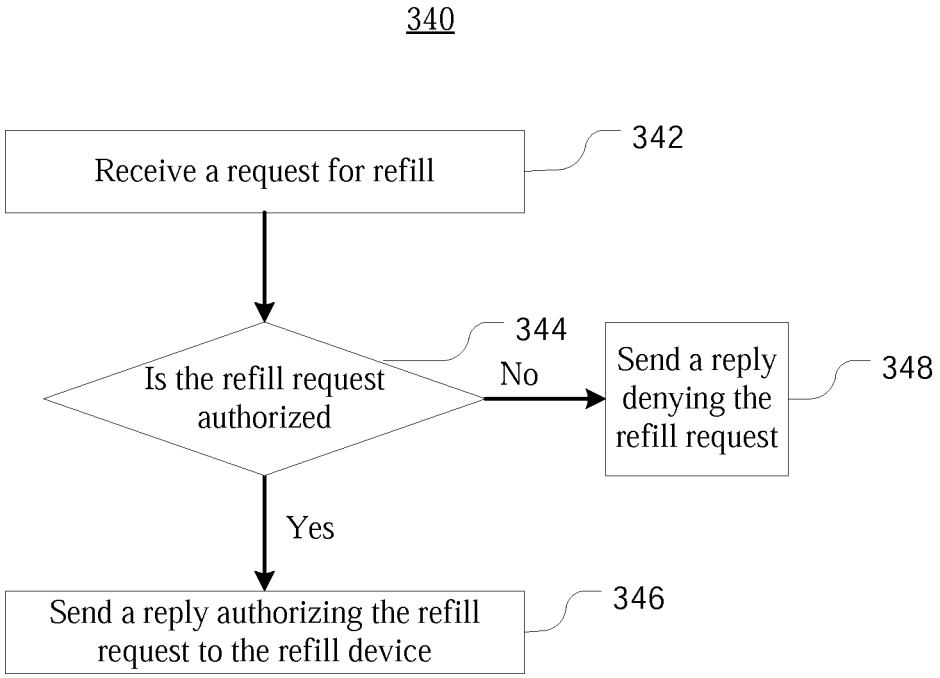
FIG. 3C is a flow diagram of an exemplary process for an exemplary central server to authorize a refill according to the present disclosure.

FIG. 3C is a flow diagram of an exemplary process 340 for authorizing a refill according to the present disclosure. At block 342, the central server 230 may receive a request for refill (e.g., a request comprising or including the request for refill 360) sent from the refill device 210. At block 344, the process 340 may decide whether the request for refill should be authorized. The central server 230 may verify that the refill device 210 (identified by the device identifier 368 in the request) may be an authorized refill device and associated with an authorized owner or operator, that the refill device 210 may indeed have an authorized toner container (identified by the container identifier 366 in the request), and that the authorized toner container has a sufficient amount of toner to satisfy the amount of toner requested. For example, the central server 230 may query its database 235 using the device identifier 368 and container identifier 366 for the verification. In one non-limiting embodiment, if the cartridge identifier is also included in the request for refill, the central server 230 may have access to a database storing cartridge identifiers for authorized cartridges. In this case, the central server 230 may also verify that the cartridge is an authorized cartridge by searching its database for authorized cartridges.

In some embodiments, the central server 230 may take into account any potential physical inaccuracies in determining whether there is a sufficient amount of toner in the container. For example, the central server 230 may assume that the container 212 may actually have slightly more toner than the information stored in the database 235 indicates. In some embodiments, the central server 230 may store a public key corresponding to the private key 214 of the refill device 210. In these embodiments, if the request for refill 360 is signed by the private key 214, the central server 230 may use the public key to verify the signature. The public key may be stored in the database 235 or in another database.

If all of the verifications are successful, the process 340 may proceed to block 346, at which the central server 230 may generate a reply to authorize the refill and send the authorization to the refill device 210. If any one of the verifications fails, the process 340 may proceed to block 348, at which the central server 230 may generate a reply to deny the refill. In one non-limiting embodiment, the reply may include the nonce 362 received in the request and may be signed by the private key 237 stored at the central server 230. Also, in some embodiments, the reply may additionally be encrypted using the private key 237 (so that only the cartridge chip 115 may recognize the authorization by decrypting the reply using the key 124, which may be the public key corresponding to the key 237 as described above).

In some embodiments, to enable detection of unauthorized refilling, each chip 115 may have a globally unique private key and a chip ID. The private key may have a corresponding public key stored at the central server 230 or stored at a third party but accessible by the central server 230. The chip 115 may use this private key to sign a request for refill 360 or sign just part of such a request (e.g., only signing the nonce 362). The signature and the chip ID may be sent, together with the request for refill, to the server 230. The central server 230 may keep records for all refill activities associated with each chip ID. When a request to refill is received, the server 230, using the chip ID, may obtain the public key corresponding to the private key and verify the signature. If the signature verification fails, the request for refill may be denied. If the signature verification passes, this refill activity may be added to the database for the chip ID.

Further, records of the refill activities associated with a requesting chip may be analyzed. For example, if the historical information shows that a particular chip signs too many requests for refill (e.g., within a certain period of time), this may indicate that this particular chip has been cloned, and, therefore, requests signed by the private key associated with the chip ID of this particular chip should be rejected.

Figure 4A:
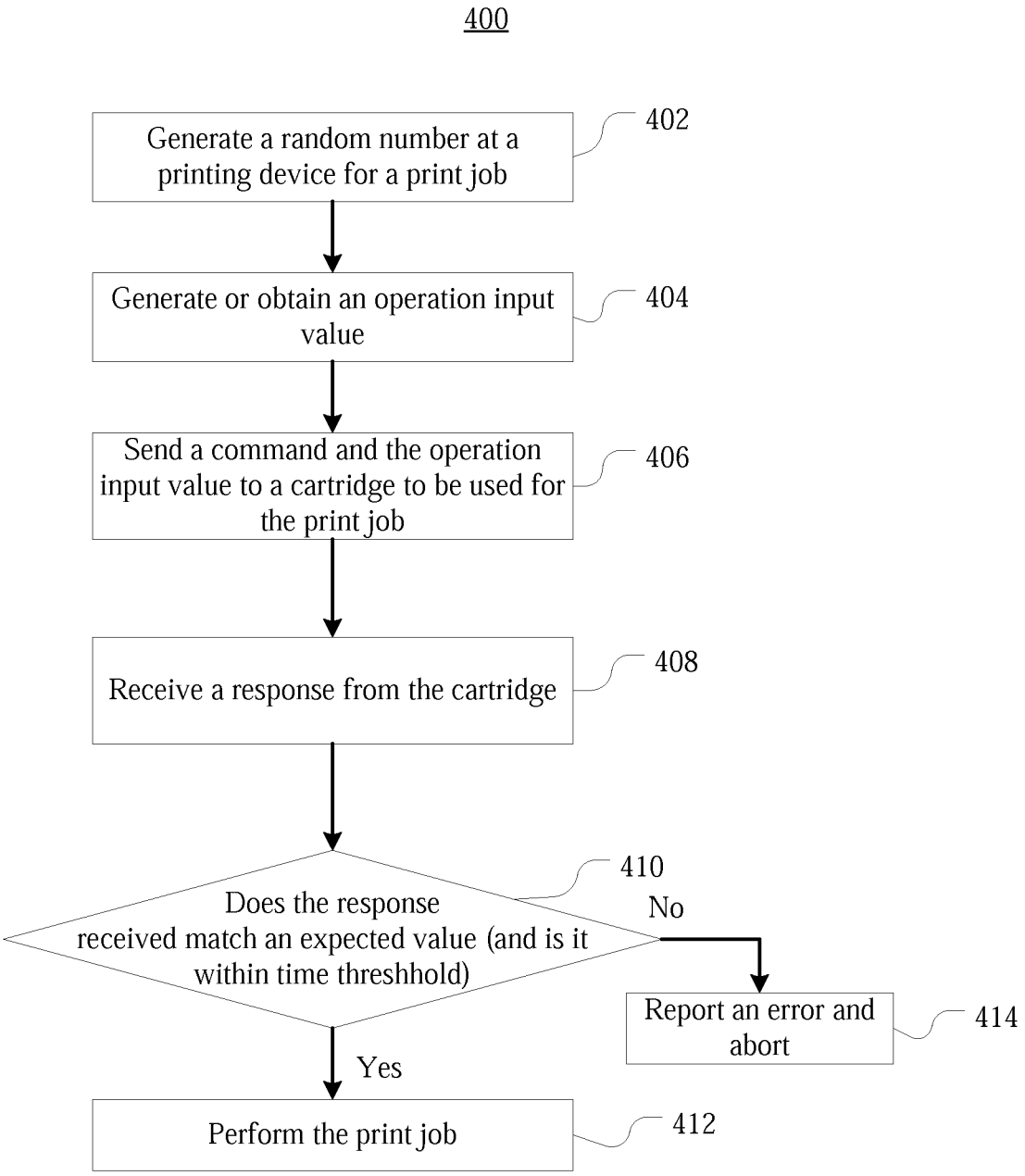
FIG. 4A is a flow diagram of an exemplary process performed by a printing device during a printing operation.

FIG. 4A is a flow diagram of an exemplary process 400 performed by a printing device during a printing operation. At block 402, the printing device 140 may generate a random number for a print job. For example, a print job from a computer (not shown) may be received by the printing device 140. The printing device 140 may estimate how much toner it needs to perform this job and generate a random number R using the RNG 142. The estimated amount of toner needed may be referred to as DINC. At block 404, the printing device 140 may generate or obtain an operation input value RR. In some embodiments, the operation input value RR may be a set of random bits. For example, the random number R generated in block 402 may be used as RR. That is, RR=R, in which case the block 404 may be skipped. In some other embodiments, the operation input value RR may not be a pure random number. For example, one bit of RR (e.g., the highest bit or the lowest bit) may always be set to 1 but all other bits may be random. In yet other embodiments, the operation input value RR may be an element of a finite field or some other construction, which may be fully or in part built based on the random number R as an input.

At block 406, the printing device 140 may send a command and the operation input value RR (or the random number R if the optional block 404 is skipped) to the cartridge chip 115 (e.g., via the interface 130). The command may request the cartridge chip 115 to reduce the amount of toner recorded in memory 120 by DINC. The operation input value RR may be used by the cartridge chip 115 to perform a predefined operation and return a response based on that operation to the printing device.

At block 408, the printing device 140 may receive a response back from the cartridge chip 115. The response, for example, may include a calculation result generated by the computation module 128. Then at block 410, the printing device 140 may determine whether the response matches an expected value and, optionally, may determine whether the response is received within a pre-defined time threshold. The pre-defined time threshold may be any finite amount of time. For example, the printing device 140 may perform a calculation using its computation module 144 and compare the calculation result in the response to its own calculation result. In embodiments in which the response time is checked against a pre-defined time threshold, the fact that the cartridge 110 includes a chip 115 that can perform the predefined operation sufficiently fast to return the verification value to the printing device within the time threshold may serve as an assurance that the cartridge is a valid cartridge. Exemplary techniques for attesting a device (e.g., a cartridge) by selecting appropriate time thresholds are described in U.S. Provisional Patent Application No. 61/792,392, entitled "Systems, Methods and Apparatuses for Device Attestation Based on Speed of Computation," and filed on Mar. 15, 2013, the entirety of which is incorporated herein by reference.

If the calculation result in the response matches the expected value (and optionally is received within a pre-defined time threshold), the process 400 may proceed to block 412, at which the print job may be performed by dispensing toner from the cartridge 110. As described above, authorized cartridges may have chips that are capable of performing the pre-defined operation sufficiently fast such that the amount of time that passes from when the command is sent by the printing device to the time that the response is received by the printing device is within a predefined time threshold. Thus, by checking that the calculation result is received within the certain time threshold, the process 400 may ensure that an authorized cartridge has been used for this print job. In one embodiment, if the interface 130 between the printing device 140 and cartridge 110 is serial, the time it takes to receive the calculation result may be measured from when the last bit of the RR (or R) is transmitted until when the first bit of the response containing the calculation result is received.

If, however, the calculation result check fails (and/or the result is received outside the pre-defined time threshold), then process 400 may proceed to block 414, at which the print job may be aborted and an error may be reported (e.g., on a user interface of the printing device 140, and/or sent to a computer that sends the print job, and/or sent to a monitoring device coupled to the printing device 140).

Figure 4B:
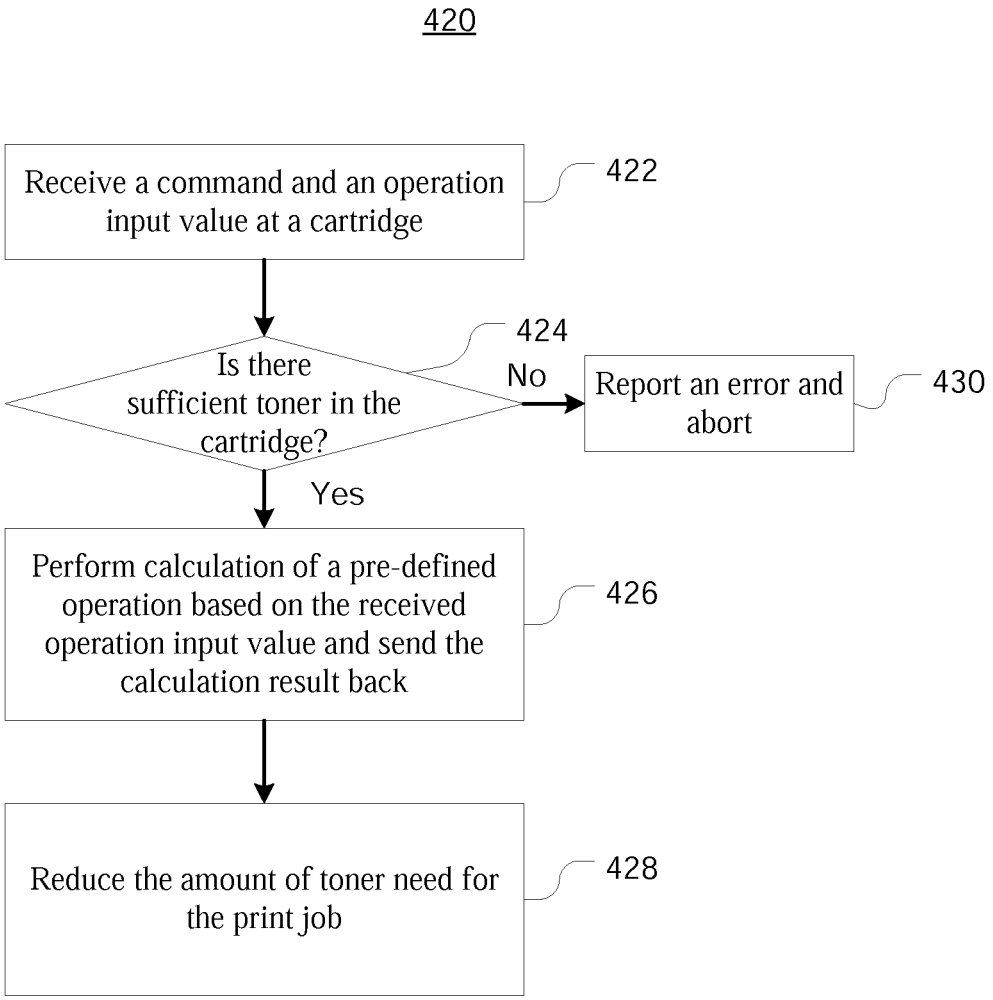
FIG. 4B is a flow diagram of an exemplary process performed by a cartridge during a print operation.

FIG. 4B is a flow diagram of an exemplary process 420 performed by a cartridge during a printing operation. At block 422, the cartridge 110 may receive a command and an operation input value. The command and operation input value may be the command and operation input value RR (or R) sent at block 406 by a printing device 140. As described above with respect to block 406, the command may include the estimated value DINC for the amount of toner needed to perform the print job. Then at block 424, the cartridge chip 115 may check to determine if there is sufficient toner left in the cartridge to perform the print job. For example, the cartridge chip 115 may check if the value DINC is less than the amount of toner recorded in the memory 120. If there isn't enough toner, the process 420 may proceed to block 430, at which a report may be generated (e.g., on a user interface of the printing device 140, and/or sent to a computer that requests the print job, and/or sent to a monitoring device coupled to the printing device 140) and the process 420 may be aborted.

If there is enough toner, the process 420 may proceed to block 426, at which the cartridge chip 115 may perform calculation of a pre-defined operation and return the calculation result back to the printing device 140. The calculation may be performed by the computation module 128 based on the received value of RR (or R). As described above, the computation module 128 may be a special purpose hardware computation module configured to perform fast computation of the pre-defined operation, and the printing device may rely on the fact that it received the expected (or verification) value within the predefined time threshold as an assurance that the computation was performed by a computation module 128 of a valid cartridge rather than, for example, a software emulator.

At block 428, the process 420 may reduce the amount of toner recorded in memory 120 for the print job. For example, the cartridge chip 115 may decrement the amount of toner recorded in memory 120 by the estimated value DINC. It should be noted that the blocks 426 and 428 may be performed in any order, interleaved, or parallel. However, it should be noted that in some embodiments, the calculation result generated at block 426 may need to be sent back to the printing device as fast as possible for the purposes of device attestation.

It is to be recognized that the method 420 may be modified without departing from the scope of the present invention. By way of example and not limitation, the determination at block 424 may be performed by tracking the amount of toner used from the cartridge (instead of the amount of toner remaining in the cartridge). More particularly, for example, the cartridge chip may record the amount of toner used from the cartridge by keeping a cumulative sum of the amounts DINC and comparing that cumulative sum to the maximum capacity of the toner cartridge. In other words, the comparison at block 424 may be performed by subtracting the amount of toner that would be used (i.e., all amounts used since the toner was last filled or refilled and the amount to be used presently) from the maximum toner capacity of the cartridge. In such an embodiment, at block 428 the process 420 may add the amount of toner used during the current print job to the amount of toner used in all print jobs since the cartridge was last filled or refilled and store that value in the memory 120.

In another non-limiting embodiment of the present disclosure, instead of the cartridge chip 115 performing the calculations to determine whether there is sufficient toner to perform the print job and the amount of toner remaining after the print job has occurred, these determinations may be made by another device or component and a new toner amount may be provided to the cartridge chip 115 and recorded in the memory 120. By way of example and not limitation, the cartridge chip 115 may provide the amount of toner to the printer 140 and the printer may calculate a new amount of toner after accounting for the current print job. The printer may then send the new amount of toner to the cartridge chip 115 to be stored in the memory 120 as the new or updated amount of toner. The cartridge chip 115 may verify that this new amount of toner is less than the amount of toner currently stored in the memory 120 before allowing the amount of toner in the memory to be updated. In such an embodiment, the cartridge chip 115 may allow the update request to be non-signed if it decreases the amount of toner but require that the update request to be signed if it increases the amount of toner.

In some embodiments, the calculation of a pre-defined operation by the cartridge 110 at block 426 (and, correspondingly, the verification whether the response matches an expected value and is received within a pre-defined time threshold performed by the printing device 140 at block 410) may be omitted. In these embodiments, the chip 115 need not have a computation module 128, and the printing device 140 need not have a computation module 144 and RNG 142.

In certain circumstances, for commercial or implementation reasons, it may be desired that the cartridge 115 not be capable of being refilled while still desiring to maintain the capability to perform a verification before allowing a print job. In such an embodiment, the chip 115 incorporated into the cartridge 110 need not have a RNG 122, key 124 and signature verification module 126.

Figure 5:
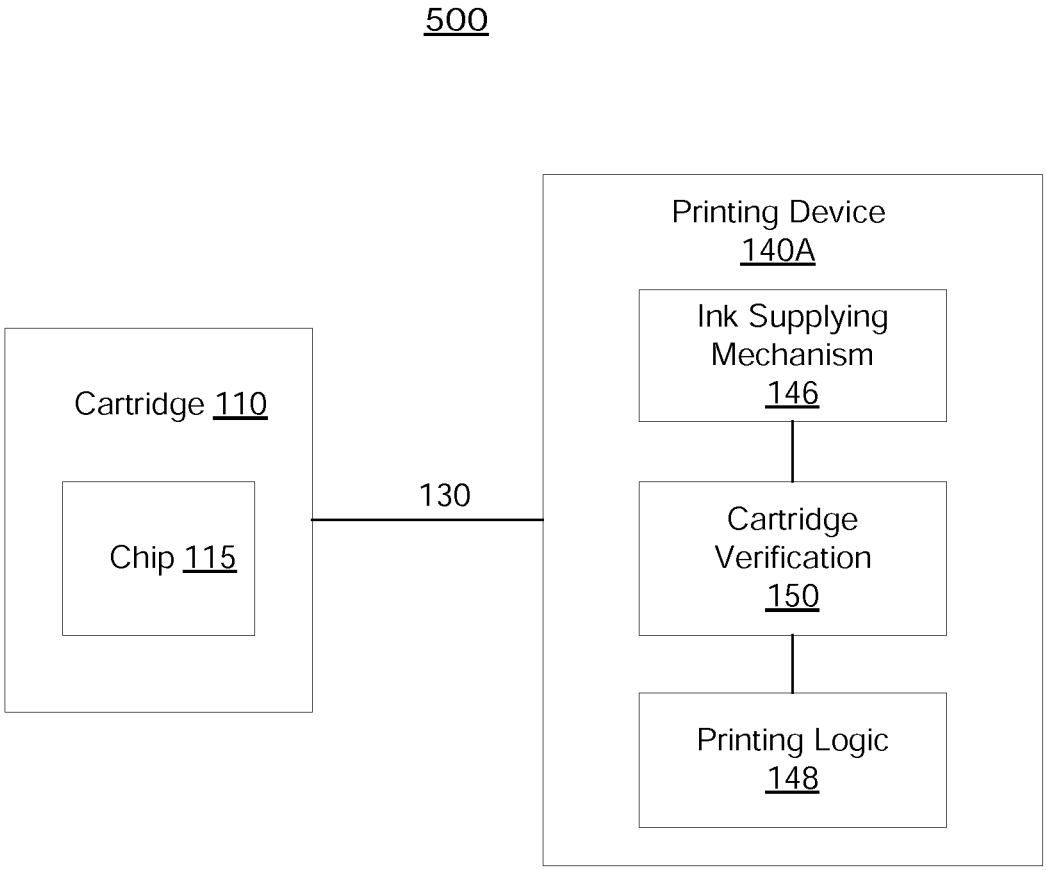
FIG. 5 is a block diagram of another exemplary system for using an exemplary printing device according to the present disclosure.

In some embodiments, a printer device according to the present disclosure may implement protection measures against unauthorized attempts to reprogram the device. FIG. 5 shows a block diagram of an exemplary system 500 for using an exemplary printer device 140A according to the present disclosure. The exemplary printer device 140A may be an embodiment of the printer device 140 and may use a cartridge 110 for printing jobs. The cartridge 110 may be identical to the cartridge 110 shown in FIG. 1 and the chip 115 in FIG. 5 may also be identical to the chip 115 in FIG. 1 (details of the chip 115 in FIG. 5 are omitted for simplicity). The printer device 140A may comprise an ink supplying mechanism 146, a printing logic block 148, and a cartridge verification block 150. The printing logic block 148 may implement the printing logic in hardware, software, or combination of hardware and software. For example, the printing logic block 148 may be a micro controller unit (MCU) or a central processing unit (CPU) at which code responsible for performing printing operation may be executed.

The cartridge verification block 150 may be, for example, an ASIC. The ASIC may include, for example, an RNG 142 and a computation module 144 as shown in FIG. 1, and may implement the verification process 400 as described above. If the verification is passed successfully, the verification block 150 may inform the block 148, which then forms commands for the ink supplying mechanism 146. To avoid unauthorized printing even if the block 148 is reprogrammed, all commands from the block 148 to the ink supplying mechanism 146 may be sent through the verification block 150. Thus, the verification block 150 may effectively serve as a switch, allowing commands to go through if the cartridge verification is passed, and blocking commands otherwise. Correspondingly, in such embodiments, unauthorized reprogramming of the printing logic 148 will not lead to any unauthorized printing operations.

In some embodiments, as an additional protection measure (for example, against attacks that attempt to expose the cartridge 110 or the chip 115 to certain environmental conditions, such as high or low temperatures, electric and/or magnetic fields, etc.), a checksum (for example, a CRC-32 checksum) may also be stored (for example, within non-volatile memory 120) in addition to the amount of toner remaining in the cartridge or amount of toner used from the cartridge. The checksum can be used to ensure that the amount of toner read from memory is correct and, if it is not, the chip 115 may, for example, return an error message to the printing device. To avoid accidental checksum failure, the chip 115 may optionally store (in addition to the checksum or instead of the checksum) an error correction code. Exemplary error correction codes may include variations of a Hamming code (for example, the Hamming (39,32) code), Reed-Solomon codes, multidimensional parity check codes, triple modular redundancy codes, or any other type of error correction code, known in the art, or developed in the future. Such an error correction code may be formed and checked, for example, in a memory controller (not shown) of the chip 115. If an error occurs and is capable of being corrected, the chip 115 may correct the error and proceed with the methods and techniques described herein using the amount of toner obtained from the error correction process.

Further, the checksum and/or the error correction method may be selected such that it can detect when the memory appears to be in a certain default state (e.g., all of the bits of the memory 120 become set to 1) as a result of exposure to certain environmental conditions (e.g., extreme heat or extreme cold). For example, in an embodiment in which the default state of the bits in the memory is 1, the checksum of a memory bit sequence with all bits being 1 should not have a value with the binary representation of all 1s because, being stored in the same memory 120, such a checksum may also become a value with all bits set to 1 as a result of the exposure to the same environmental conditions.

It should be noted that a value representing a current state of the RNG 122 may be protected by adding checksums and/or error correction codes as described above with respect to the amount of toner remaining in the cartridge or the amount of toner used from the cartridge.

As additional measures of protection against attacks directed to exposing the cartridge chip 115 to certain conditions, the chip 115 may be configured to detect changes in environmental parameters. By way of example and not limitation, such parameters may include temperature, power supply voltage, frequency of clock generator (if a clock signal is generated externally), and the like. If changes to one or more of these parameters beyond permissible bounds are detected, the chip may be configured to stop operating (temporarily or permanently), to report an error, or to take other corrective action.

In one or more embodiments, the data transmission rate of the interface 130 between the cartridge and the printing device may be performed at a high frequency (e.g., on the order of the Mbit/s or faster) to prevent attacks by interception. For example, an unauthorized cartridge may pretend to be an authorized cartridge by passing the received RR (or R) to a high-speed CPU/GPU that runs a software emulator and perform the computation using the CPU/GPU, and pass the result back. To protect against such attacks, the data transmission rate of the interface 130 may be set to at least 10 MBit/s and even as high as approximately 100 MBit/s.

In some embodiments, checksums (such as cyclic redundancy check) may be sent over the interface (e.g., the interface 130) from the printing device to a cartridge. For example, checksums may be sent for each command and sometimes even for data chunks smaller than a single command. When checksums are used, the cartridge chip may send a checksum error back as soon as the first checksum check fails. In one embodiment, if a checksum check fails, the printing device may be configured to generate completely new R and RR and restart the process instead of trying to retransmit the data chunk that failed the checksum check. Moreover, in cases of checksums being used for small data chunks, the printing device may collect statistics on the communications with the cartridge. If checksum errors occur too often, or errors are skewed towards the last chunks (which may indicate an attempt to attack), the printing device may show error messages on a user interface (either directly on the printing device, or to the device which generates the print job). In some embodiments, the error message may prompt a user to replace the cartridge or to re-insert the cartridge. In a non-limiting embodiment, the printing device may implement a time-out (e.g., a few seconds) before retrying to communicate with the cartridge.

In some embodiments, checksums may also be added by the cartridge when transmitting data to the printing device. The checksums may be added to a reply message to be sent to the printing device or may be added to data chunks smaller than the reply message. The printing device may also collect statistics on successful/unsuccessful validation of these checksums. If the statistics show that checksums are failing too often, the printing device may show an error message to ask the cartridge to be re-inserted or replaced, and may implement a time-out before retrying to communicate with the cartridge. In addition, even if some checksums for some data chunks have already failed, the printing device may still check the checksums of other data chunks to determine whether the content of the other checksums is correct. If the other checksums are also incorrect, then there is a possible attack and the printing device may, for example, prompt a user to re-insert or replace the cartridge after a timeout.

In one embodiment, the data may be passed over the interface 130 in a serial manner. The full set of data to be transmitted may include multiple parts, for example, some parts may contain bits that are easier to predict (such as, for instance, (unencrypted) value of DINC) and some parts may contain bits that are harder to predict (such as, for instance, the value of RR). If the portion of the data containing easy to predict bits is sent after the portion of the data containing hard to predict bits, an attacker may start computations before receiving all the bits. For example, the attacker may start computation after receiving the data bits that are hard to predict and then start computation based on statistical predictions of the data not yet received with a hope that the predictions match the data bits actually received later. Alternatively, the attacker may perform computations for a few different predictions in parallel and hope one prediction will match the data bits actually received later. Thus, if the data bits are not transmitted in an easy to predict then hard to predict order, the attackers may get extra time for computations. To address this issue, in one or more embodiments, the data bits that may be easy to predict may be transmitted earlier than the data bits that may be hard to predict.

In one embodiment, the computation module 126 may comprise separate sub-modules to perform different calculations. In some implementations for these embodiments, the printing device 140 may send an instruction to select one of the sub-modules for a specific calculation to be performed when issuing a command to reduce an amount of toner.

In yet another embodiment, during a refill operation, the signed reply from the central server 230 may contain additional information (such as a refill device identifier 216, toner container identifier 213, etc.) which the cartridge chip 115 may store in the memory 120. This additional information may be accessible to the printing device 140 by special commands via the interface 130. In one non-limiting embodiment, this information may be used to help analyze cartridge failures caused by toner.

In another embodiment, during the refill operation, the signed reply from the central server 230 may also contain information about the type of toner. This information may be stored by the chip 115 and accessible by the printing device 140. In one embodiment, this may help reuse the same cartridge 110 for different types of toner by allowing the printing device 140 to check that the cartridge in the printing device slot has the correct type of toner. Reuse cartridges may help, for example, reduce storage requirement for empty cartridges.

In some embodiments, the central server 230 may collect real-time information about the cartridges requesting a refill and the refill device performing the refill. In one non-limiting embodiment, the central server 230 may use such information to perform a variety of functions. For example, the central server 230 may use the information about the refill device to impose restrictions on refill operations (e.g., it is known that this refill device should only be in operation from 8 am to 6 pm, so if a request is received from it at 3 am then something is probably wrong; and/or if a refill device is known to be located in United States, but a request purportedly from the refill device is received from an IP address registered in England, then something is probably wrong). In addition or alternatively, the central server 230 may use the information to perform statistical analysis, such as calculating statistics for remaining stocks of toner at the refill device, geographical locations of the refill operation, etc.

It is to be understood that the various embodiments disclosed herein are not mutually exclusive and that a particular implementation may include features or capabilities of multiple embodiments discussed herein.

While specific embodiments and applications of the present invention have been illustrated and described, it is to be understood that the invention is not limited to the precise configuration and components disclosed herein. The terms, descriptions and figures used herein are set forth by way of illustration only and are not meant as limitations. Various modifications, changes, and variations which will be apparent to those skilled in the art may be made in the arrangement, operation, and details of the apparatuses, methods and systems of the present invention disclosed herein without departing from the spirit and scope of the invention. By way of non-limiting example, it will be understood that the block diagrams included herein are intended to show a selected subset of the components of each apparatus and system, and each pictured apparatus and system may include other components which are not shown on the drawings. Additionally, those with ordinary skill in the art will recognize that certain steps and functionalities described herein may be omitted or re-ordered without detracting from the scope or performance of the embodiments described herein.

The various illustrative logical blocks, modules, circuits, and algorithm steps described in connection with the embodiments disclosed herein may be implemented as electronic hardware, computer software, or combinations of both. To illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. The described functionality can be implemented in varying ways for each particular application—such as by using any combination of microprocessors, microcontrollers, field programmable gate arrays (FPGAs), application specific integrated circuits (ASICs), and/or System on a Chip (SoC)—but such implementation decisions should not be interpreted as causing a departure from the scope of the present invention.

The steps of a method or algorithm described in connection with the embodiments disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art.

The methods disclosed herein comprise one or more steps or actions for achieving the described method. The method steps and/or actions may be interchanged with one another without departing from the scope of the present invention. In other words, unless a specific order of steps or actions is required for proper operation of the embodiment, the order and/or use of specific steps and/or actions may be modified without departing from the scope of the present invention.

What is claimed is:

1. A chip for a cartridge with dispensable material, comprising:

a non-volatile memory for storing a number tracking amount of dispensable material in the cartridge with dispensable material;

a first circuit configured to detect changes in an environmental parameter; and second circuit components configured to:

receive a first message comprising a first command and an operation input value for a print job at the cartridge;

process the first message, comprising decreasing the number tracking amount of dispensable material in the cartridge;

receive a second message comprising a second command to increase the number tracking amount of dispensable material; and ignore the second command when the first circuit has detected changes to the environmental parameter beyond permissible bounds to prevent responding to requests to increase the number tracking amount of dispensable material.

2. The chip of claim 1, wherein to process the first message the second circuit components are further configured to generate a reply.

3. The chip of claim 2, wherein the second circuit components are further configured to:

determine if there is enough dispensable material in the cartridge using the number stored in the non-volatile memory; and add an error report to the reply, if the number tracking amount is insufficient.

4. The chip of claim 2, further comprising a dedicated computation module, wherein the dedicated computation module is configured to perform a pre-defined calculation operation.

5. The chip of claim 4, wherein an input to the dedicated computation module is taken from the first message and a result of a computation is added to the reply.

6. The chip of claim 4, wherein the dedicated computation module comprises separate sub-modules to perform different calculations, and the second circuit components are further configured to receive an instruction from the printing device to select one of the sub-modules for a specific calculation.

7. The chip of claim 1, wherein the non-volatile memory further stores a checksum in addition to the number tracking amount of dispensable material, and the second circuit components are further configured to ensure the number tracking amount of dispensable material is correct using the checksum.

8. The chip of claim 1, wherein the non-volatile memory further stores an error correction code in addition to the number tracking amount of dispensable material, and the second circuit components are further configured to correct an error if the number tracking amount of dispensable material is erroneous.

9. The chip of claim 1, wherein the second circuit components are further configured to:

take a corrective action when changes in the environmental parameter beyond a permissible bound is detected.

10. The chip of claim 1, wherein the second circuit components are further configured to:

write an initial value for the number tracking amount of dispensable material in the cartridge during a chip testing procedure.

11. A method for performing operations by a chip of a cartridge with dispensable material, comprising:

receiving a first message comprising a first command and an operation input value for a print job at the chip;

processing the first message, comprising decreasing a number tracking amount of dispensable material in the cartridge, the number being stored in a non-volatile memory of the chip;

receiving a second message comprising a second command to increase the number tracking amount of dispensable material;

detecting changes in an environmental parameter with a circuit of the chip; and ignoring the second command when the circuit has detected changes to the environmental parameter beyond permissible bounds to prevent responding to requests to increase the number tracking amount of dispensable material.

12. The method of claim 11, further comprising generating a reply when processing the first message.

13. The method of claim 12, further comprising:

determining if there is enough dispensable material in the cartridge using the number stored in the non-volatile memory; and adding an error report to the reply, if the number tracking amount is insufficient.

14. The method of claim 13, further comprising performing a pre-defined calculation operation using a dedicated computation module.

15. The method of claim 14, wherein an input to the dedicated computation module is taken from the first message and result of a computation is added to the reply.

16. The method of claim 14, further comprising receiving an instruction from a printing device to select one specific calculation sub-module to perform the pre-defined calculation operation, wherein the chip comprises separate sub-modules to perform different calculations.

17. The method of claim 11, further comprising ensuring the number tracking amount of dispensable material is correct using a checksum stored in the non-volatile memory.

18. The method of claim 11, further comprising correcting an error when the number tracking amount of dispensable material is erroneous using an error correction code stored in the non-volatile memory.

19. The method of claim 11, further comprising:

taking a corrective action when changes in the environmental parameter beyond a permissible bound is detected.

20. The method of claim 11, further comprising:

writing an initial value for the number tracking amount of dispensable material in the non-volatile memory during a chip testing procedure.

* * * * *